US006872151B2

(12) United States Patent
Oyama

(10) Patent No.: US 6,872,151 B2
(45) Date of Patent: Mar. 29, 2005

(54) GOLF CLUB SHAFT

(75) Inventor: Hitoshi Oyama, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/614,118

(22) Filed: Jul. 8, 2003

(65) Prior Publication Data

US 2004/0009827 A1 Jan. 15, 2004

(30) Foreign Application Priority Data

Jul. 8, 2002 (JP) ..... 2002-198664

(51) Int. Cl.[7] ..... A63B 53/10
(52) U.S. Cl. ..... 473/319; 473/320
(58) Field of Search ..... 473/316–323

(56) References Cited

U.S. PATENT DOCUMENTS 5,156,396 A 10/1992 Akatsuka et al.
6,273,830 B1 * 8/2001 Takemura et al. ..... 473/319

FOREIGN PATENT DOCUMENTS

JP 5-49717 A 3/1993

* cited by examiner

*Primary Examiner*—Stephen Blau
(74) *Attorney, Agent, or Firm*—Birch, Stewart, Kolasch & Birch, LLP

(57) ABSTRACT

A golf club shaft composed of a laminate of prepregs obtained by impregnating reinforcing fibers with a resin, the weight (g) of the golf club shaft per unit length (mm) is less than 0.0385 g/mm. Prepregs, each including a reinforcing fiber having a high tensile modulus of elasticity not less than 300 GPa and a high tensile strength not less than 5000 MPa are disposed as a part of a straight layer in which the reinforcing fibers are parallel with the axial direction of the golf club shaft.

6 Claims, 5 Drawing Sheets

GOLF CLUB SHAFT

This nonprovisional application claims priority under 35 U.S.C. § 119(a) on Patent Application No(s). 2002-198664 filed in JAPAN on Jul. 8, 2002, which is (are) herein incorporated by reference.

BACKGROUND OF THE INVENTION

1. Field to the Invention

The present invention relates to a golf club shaft and more particularly to a golf club shaft, made of a fiber reinforced resin, in which the structure of prepregs is specified and which is lightweight and has an appropriate rigidity and a high strength.

2. Description of the Related Art

In the case where prepregs in which fibers are impregnated with a resin is used as the material of the golf club shaft, the prepregs are molded by winding on a mandrel a so-called straight layer whose reinforcing fiber is parallel with the major axis of the golf club shaft or alternatively an angular layer whose reinforcing fiber forms a certain angle with the major axis of the golf club shaft.

In recent years, the art for making lightweight shafts have been developed. The lightweight shaft is required to have a proper degree of rigidity and a high strength. Therefore there are various proposals made to improve the material of prepregs composed of the lightweight shaft and the laminated structure thereof and to improve the strength of the lightweight shaft.

For example, in the shaft disclosed in Japanese Patent Application Laid-Open No.5-49717, the straight layer has a two-layer structure consisting of an inner layer and an outer layer. The inner layer is made of carbon fiber having a high elasticity, whereas the outer layer is made of carbon fiber having a high strength. Thus the shaft has a weight of less than 63 g when the entire length of the shaft is 45 inches. That is, a shaft which is lightweight and has a proper degree of rigidity is proposed.

The shaft disclosed in Japanese Patent Application Laid-Open No.5-49717 uses prepregs of different kinds in combination, namely, a prepreg having a high elasticity and an intermediate strength and a prepreg having a high strength and an intermediate elasticity. Thus to achieve a shaft having an appropriate rigidity and a high strength, it is inevitable that the number of prepregs increases and hence the shaft becomes heavy. Thus although it is described in the specification that the prepreg has a high elasticity and a high strength, in fact, the prepreg has an insufficient strength. Thus the flexural strength is affected by carbon fiber having a low strength and a high elasticity. That is, the shaft having the above-described structure is incapable of providing sufficient strength.

To make the shaft lightweight, it is necessary to decrease the amount of the reinforcing fiber to be used. A decrease in the amount of the reinforcing fiber leads to a reduction of the strength of the shaft. The reinforcing fiber for the conventional shaft has a problem that one reinforcing fiber has a high tensile modulus of elasticity and hence a high rigidity but has an insufficient strength and other reinforcing fibers have a high tensile strength and hence a high strength but a low rigidity. There is proposed a laminated structure in which the advantage of both reinforcing fibers are utilized by combining both reinforcing fibers appropriately with each other. However, it is difficult to make the shaft lightweight. As such, there is a demand for the development of a shaft that has the smallest possible amount of reinforcing fibers and that of prepregs to be layered one upon another and yet has a sufficient strength and an appropriate degree of rigidity (flexure).

SUMMARY OF THE INVENTION

The present invention has been made in view of the above-described problems. Therefore it is an object of the present invention to provide a golf club shaft that is lightweight and has an appropriate rigidity and a high strength.

To achieve this object, according to the present invention, there is provided a golf club shaft composed of a laminate of prepregs obtained by impregnating reinforcing fibers with a resin.

In this construction, prepregs each including a high-elasticity and high-strength reinforcing fiber having a high tensile modulus of elasticity not less than 300 GPa and a high tensile strength not less than 5000 MPa are disposed as a part of a straight layer in which the reinforcing fibers are parallel with the axial direction of the golf club shaft; and the weight (g) of the golf club shaft per unit length (mm) is less than 0.0385 g/mm.

To obtain a shaft that is lightweight, has a proper degree of rigidity, and has a high strength, the present inventors have investigated various materials of the reinforcing fiber and layering structures of prepregs. As a result, they have found that it is possible to realize a shaft having an appropriate degree of rigidity (flexure) and a high strength by disposing prepregs including the above-described reinforcing fiber having a high tensile modulus of elasticity and a high tensile strength as a part of the straight layer which contributes to an increase of the flexural strength of the shaft.

By disposing the prepreg including the reinforcing fiber having a high tensile modulus of elasticity and a high tensile strength (reinforcing fiber having a high tensile modulus of elasticity and a high tensile strength is hereinafter referred to as "high-elasticity and high-strength reinforcing fiber") as a straight layer, it is possible to realize a shaft having a desired rigidity and a high strength efficiently without using prepregs including reinforcing fibers of various kinds and without increasing the weight thereof. Thus it is possible to improve the degree of freedom in designing a lightweight shaft. The present invention provides a high-performance a lightweight shaft in which the ratio of the weight (g) to the length (mm) thereof is less than 0.0385 g/mm.

The reason the tensile modulus of elasticity of the high-elasticity and high-strength reinforcing fiber is set to be not less than 300 GPa is as follows: If the tensile modulus of elasticity of the high-elasticity and high-strength reinforcing fiber is less than 300 GPa, the rigidity (hardness) of the reinforcing fiber is insufficient. The reason the tensile strength of the high-elasticity and high-strength reinforcing fiber is set to be not less than 5000 MPa is as follows: If the tensile strength of the high-elasticity and high-strength reinforcing fiber is less than 5000 MPa, the strength of the reinforcing fiber is insufficient. Thus by using the high-elasticity and high-strength reinforcing fiber, the shaft is lightweight and has an appropriate degree of rigidity and a high strength. The larger the tensile modulus of elasticity and tensile strength of the high-elasticity and high-strength reinforcing fiber, the more favorable is the high-elasticity and high-strength reinforcing fiber. It is possible to appropriately adjust the configuration, thickness, and disposition of the prepreg including the high-elasticity and high-strength reinforcing fiber, the number of the prepregs to be layered, and the number of turns of the prepregs in dependence on required performance.

The weight (g) of the shaft per unit length (mm) is set to be less than 0.0385 g/mm and advantageously not less than 0.0255 g/mm.

It is favorable that the high-elasticity and high-strength reinforcing fiber is a carbon fiber and that a ratio of the weight of the high-elasticity and high-strength reinforcing fiber to the weight of entire reinforcing fibers of the straight layer of not less than 50%. If the above-described ratio is less than 50%, it is difficult to achieve a shaft of light weight and provide a proper degree of rigidity and a high strength. The above-described ratio is more favorably not less than 60% nor more than 85% and most favorably not less than 70% nor more than 80%.

It is preferable that a T-point flexure strength is not less than 1600N in a test method to be carried out in accordance with a three-point flexure test of "Authorization standard of golf club shaft and standard confirmation method" (Admission 5 of the Ministry of International Trade and Industry, No.2087) provided by the Product Safety Association. In the case where the T-point flexure strength is not less than 1600N, a golfer can use the shaft without anxiety. If the T-point bending strength is less than 1600N, the shaft is liable to be broken when the golfer hits a golf ball at a position proximate to the neck of the shaft. Thus it is difficult for an average golfer who has difficulty in hitting the golf ball at an aimed point to use the golf club without anxiety.

It is preferable that the thick part of the shaft is formed in a range from the tip of the golf club shaft to a position located in a range spaced at an interval of 70 mm to 150 mm from the tip; that the thickness of the thick part is set to be not less than 1.4 mm nor more than 2.8 mm, and that the thickness change rate of the thick part is set to be less than 5/1000. By forming the thick part at the tip side of the shaft, it is possible to provide a shaft which is lightweight and has a proper degree of rigidity and a high strength.

The reason that the thick part is formed in the range from the tip of the shaft to a position located in the range spaced at the interval of 70 mm to 150 mm from the tip is as follows: If the thick part is located in the range from the tip to the position spaced at the interval of 70 mm from the tip, the thick part is so short that it does not have a reinforcing effect and hence its strength is insufficient. On the other hand, if the thick part is located in the range from the tip to the position spaced at the interval of 150 mm from the tip, the thick part is so long that it is difficult to make the shaft lightweight and further the tip part is so hard that the golf ball cannot be hit high.

The reason the thickness of the thick part is set to the above range is as follows: If the thickness of the thick part is less than 1.4 mm, it is difficult to allow the tip side of the shaft to have sufficient strength. On the other hand, if the thickness of the thick part is more than 2.8 mm, it is difficult to make the shaft lightweight and the tip side of the shaft is so hard that the golf ball cannot be hit high.

The reason the thickness change rate of the thick part is less than 5/1000 is as follows: If the thickness change rate of the thick part is more than 5/1000, the change of the strength of the thick part is large. Thus it is necessary to provide the thick part with a strength so that the shaft is not broken. Consequently it is necessary to increase the weight of the shaft.

It is preferable that a thickness transition part having a length of not less than 50 mm nor more than 150 mm is formed adjacent to the butt of the thick part with a thickness change rate of the thick part being T1 and a thickness change rate of the thickness transition part being T2. Thereby it is possible to enhance the rigidity of the tip side of the shaft efficiently without increasing its weight.

The reason the length of the thickness transition part is set to the above-described range is as follows: If the length of the thickness transition part is less than 50 mm, the shaft is thick as a whole, which makes it difficult to make the shaft lightweight. If the length of the thickness transition part is more than 150 mm, there is the possibility that the strength thereof at its grip side is adversely affected thereby.

If T2 is smaller than 3T1, the change of the thickness is so rapid that the shaft is liable to be broken due to a concentration of stress at the point where the thickness change rate of the thickness transition part changes. On the other hand, if T2 is larger than 2T1, the thickness transition part is long. Thus it is difficult to make the shaft lightweight.

It is preferable that at least one layer of a prepreg having the high-elasticity and high-strength reinforcing fiber is disposed over the whole length of the shaft and that a prepreg of a straight layer having a reinforcing fiber whose tensile modulus of elasticity is lower than that of the high-elasticity and high-strength reinforcing fiber and whose tensile strength is higher than that of the high-elasticity and high-strength reinforcing fiber is disposed as a reinforcing layer at the tip side of the shaft. This laminated structure of the prepregs allows the shaft to have a proper degree of rigidity and a high strength. Further the strength of the shaft can be efficiently enhanced at the tip side thereof without increasing the weight of the shaft.

It is preferable that at least one layer of a prepreg having the high-elasticity and high-strength reinforcing fiber is disposed over a whole length of the shaft and that a prepreg of an angular layer having a reinforcing fiber whose tensile modulus of elasticity is higher than that of the high-elasticity and high-strength reinforcing fiber is disposed at an inner side of the prepreg having the high-elasticity and high-strength reinforcing fiber. It is preferable that the reinforcing fiber of the prepreg of the angular layer has a lower tensile strength than that of the high-elasticity and high-strength reinforcing fiber.

It is preferable that at least one layer of a prepreg having the high-elasticity and high-strength reinforcing fiber is disposed over the whole length of the shaft and that a prepreg of a hoop layer having a reinforcing fiber whose tensile strength is higher than that of the high-elasticity and high-strength reinforcing fiber is disposed at the inner side of the prepreg having the high-elasticity and high-strength reinforcing fiber. It is preferable that the reinforcing fiber of the prepreg of the hoop layer has a lower tensile modulus of elasticity than that of the high-elasticity and high-strength reinforcing fiber. These constructions allow the shaft to be lightweight.

In the case where other straight layer is layered on an outer side of the prepreg having the high-elasticity and high-strength reinforcing fiber, it is preferable that the reinforcing fiber of the prepreg of the other straight layer has a higher tensile strength than that of the high-elasticity and high-strength reinforcing fiber. Thereby the strength of the shaft can be further increased owing to the layering of the prepreg having the high-elasticity and high-strength reinforcing fiber.

The shaft of the present invention has the shape of a pipe, having a hollow portion, composed of the laminate of prepregs layered one upon another. More specifically, the shaft can be constructed in combination of the straight layer, the angular layer, and the hoop layer. In the straight layer, the fibrous direction of the reinforcing fiber of the prepreg is parallel with the axial direction of the shaft. In the angular layer, the fibrous direction of the reinforcing fiber of the prepreg forms a certain angle to the axial direction of the shaft. In the hoop layer, the fibrous direction of the reinforcing fiber of the prepreg is perpendicular to the axial direction of the shaft. In dependence on demanded performance, it is possible to appropriately adjust the configuration, thickness, and disposition of each prepreg, the number of the prepregs to be layered, and the number of turns of the prepregs. It is possible to appropriately alter the fibrous direction, tensile modulus of elasticity, and tensile strength of the reinforcing fiber of each prepreg other than the prepreg having the high-elasticity and high-strength reinforcing fiber so long as the alteration does not impair the effect of the present invention. It is possible to use the prepreg having the high-elasticity and high-strength reinforcing fiber as the angular layer, the hoop layer or the reinforcing layer.

The value of a grip-side flexure which is an index of the hardness of the shaft at its grip-mounting side is set to favorably not less than 120 mm nor more than 135 mm and more favorably not less than 125 mm nor more than 130 mm.

If the value of the grip-side flexure is less than 120 mm, the shaft is so hard that it is unflexible and thus a golfer cannot hit a golf ball a long distance and has a bad (hard) feeling when the golfer hits the golf ball. On the other hand, if the value of the grip-side flexure is more than 135 mm, the shaft is so soft that the directionality is bad and it is difficult for the golfer to take an impact timing.

For a reason similar to that described in the case of the grip-side flexure, the value of a head-side flexure which is an index of the hardness of the shaft at its head-mounting side is set to favorably not less than 110 mm nor more than 130 mm and more favorably not less than 115 mm nor more than 125 mm.

The length of the shaft is set to favorably not less than 850 mm nor more than 1250 mm and more favorably not less than 1000 mm nor more than 1170 mm. Thereby a golf club composed of the shaft is easy to use and has an appropriate rigidity and a high strength.

It is preferable that the outer diameter of the shaft at its tip (head-mounting side) is set to not less than 8.5 mm nor more than 10.5 mm and that the outer diameter of the shaft at its butt (grip-mounting side) is set to not less than 15.0 mm nor more than 17.0 mm.

If the outer diameter of the tip is set to less than 8.5 mm, the shaft is liable to be broken at its neck and controllability thereof is liable to deteriorate. On the other hand, if the outer diameter of the tip is set to more than 10.5 mm, it is difficult to make the shaft lightweight and the value of the rigidity at the head side thereof is so large that it is difficult to make a design in terms of the flexure of the shaft.

If the outer diameter of the butt is less than 15.0 mm, it is difficult to provide the butt side with an appropriate rigidity and hold the grip part. On the other hand, if the outer diameter of the tip is more than 17.0 mm, it is difficult to make the shaft lightweight and the grip part is so thick that it is difficult to hold the grip part.

In the shaft of the present invention, the thickness of one of prepregs to be layered one upon another is set to not less than 0.01 mm nor more than 0.15 mm and favorably not less than 0.02 mm nor more than 0.12 mm.

If the thickness of the prepreg is less than 0.01 mm, it is necessary to increase the number of turns of the prepregs. Hence the productivity of the shaft is low. On the other hand, if the thickness of the prepreg is more than 0.15 mm, a level difference between adjacent prepregs is liable to be formed and the shaft has a low strength.

As resins that can be used for the prepreg, thermosetting resin and thermoplastic resin can be used singly or in combination. In terms of strength and rigidity, the thermosetting resin is preferable. Epoxy resin is particularly preferable. In addition to the epoxy resin, unsaturated polyester resin (vinyl ester resin) can be used as the thermosetting resin. As the thermoplastic resin, polyamide resin and saturated polyester resin can be used.

As the reinforcing fibers, fibers which are used as high-performance reinforcing fibers can be used. For example, in addition to carbon fiber, it is possible to use glass fiber, graphite fiber, aramid fiber, silicon carbide fiber, alumina fiber, boron fiber, aromatic polyamide fiber, aromatic polyester fiber, and ultra-high-molecular-weight polyethylene fiber. Metal fibers may be used as the reinforcing fiber. The carbon fiber is preferable because it is lightweight and has a high strength. These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics, braids, and the like.

The golf club shaft of the present invention is applicable to all kinds of golf clubs. For example, a wooden head, an iron head or putter head can be mounted on the golf club shaft of the present invention.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

The embodiments of the present invention will be described below with reference to drawings.

Figure 1:
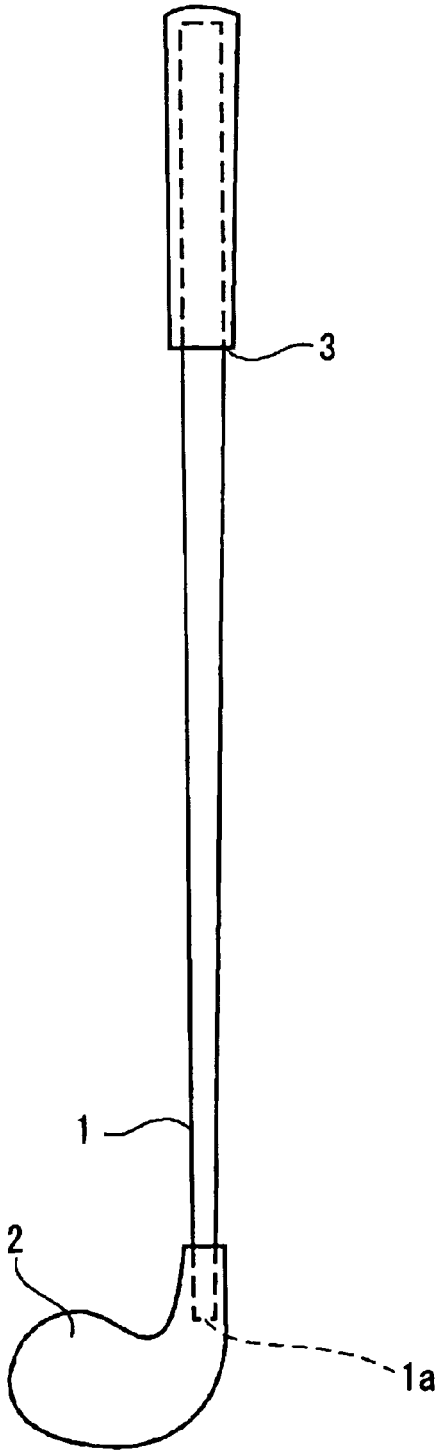
FIG. 1 is a schematic view showing a golf club using a golf club shaft according to a first embodiment of the present invention.
Figure 2:
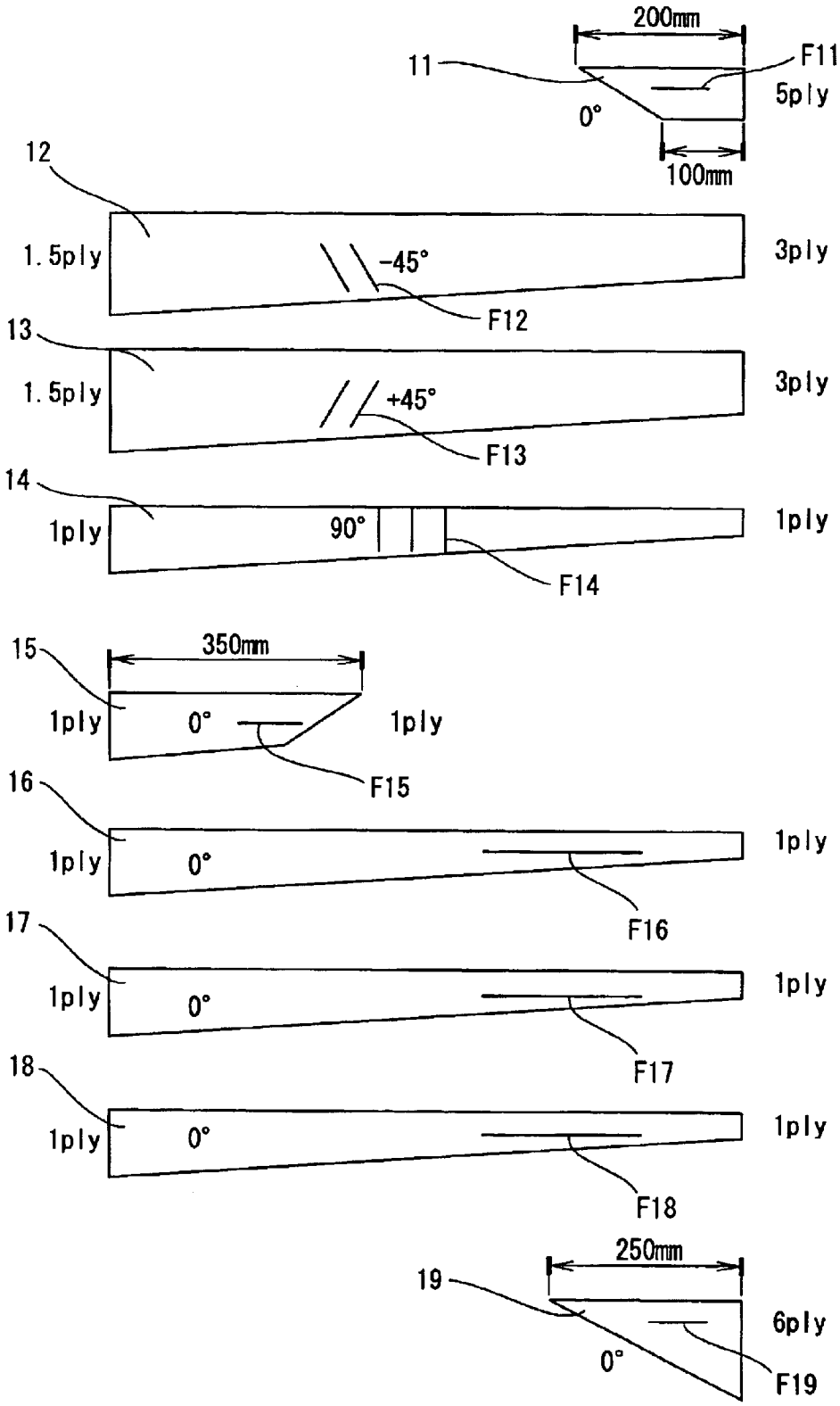
FIG. 2 shows a layering structure of prepregs for use in the golf club shaft of the first embodiment.
Figure 3:
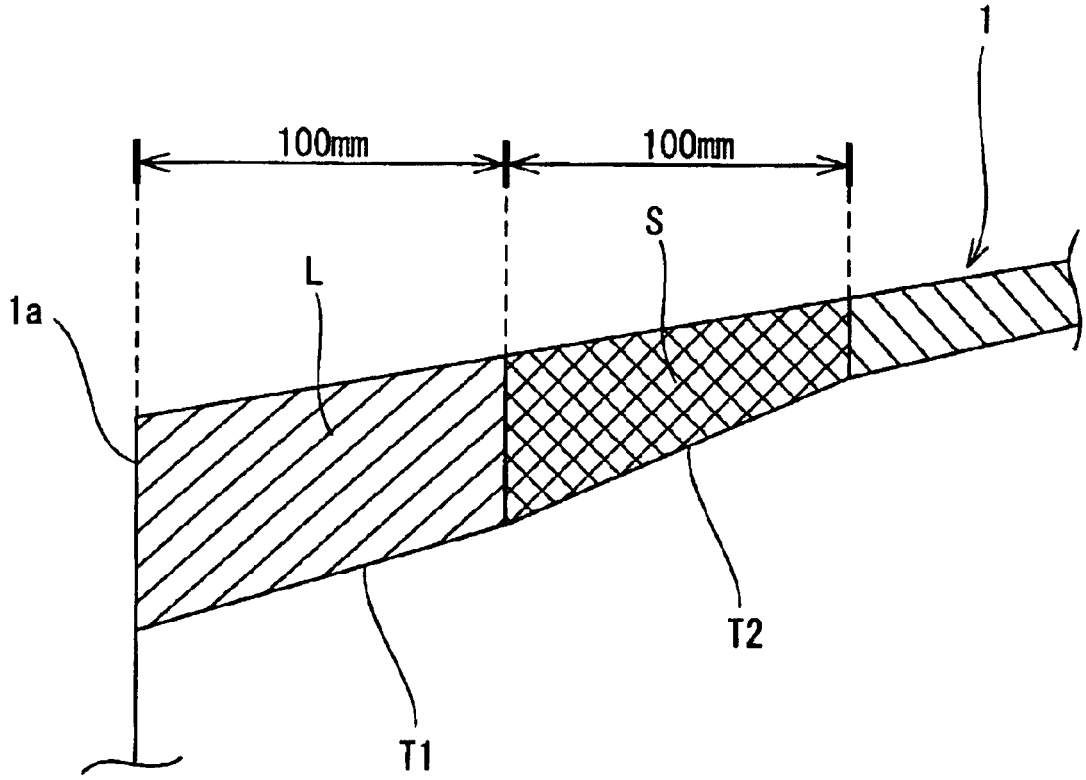
FIG. 3 is a schematic sectional view showing the tip side of the golf club shaft of the first embodiment.

FIGS. 1 through 3 show a golf club shaft (hereinafter referred to as merely shaft) according to a first embodiment of the present invention. A shaft 1 has the shape of a pipe, having a hollow portion, composed of a laminate of prepregs layered one upon another. A head 2 is installed on the shaft 1 at one end thereof having the smaller diameter. A grip 3 is installed on the shaft 1 at the other end thereof having the larger diameter. The shaft 1 tapers off from a grip-mounting side to a head-mounting side.

The straight layer of the shaft 1 has prepregs including reinforcing fibers having a high tensile modulus of elasticity of not less than 300 GPa and a high tensile strength of not less than 5000 MPa. The whole length L of the shaft 1 is set at 1168 mm. The weight of the shaft 1 is set at 44 g. Thus the weight of the shaft 1 is 0.0377 g per millimeter. The outer diameter of the shaft 1 at its tip 1*a* is set to 9.0 mm. The outer diameter of the shaft 1 at its butt is set to 15.6 mm.

The shaft 1 is formed by a sheet winding method as follows: After prepregs 11 through 19 shown in FIG. 2 are layered one upon another by sequentially winding them on a core metal (not shown) from the inner peripheral side (in the order from prepreg 11, 12 . . . 19), a tape made of polypropylene or the like is lapped on the laminate. Then integral molding is performed. That is, the tape-lapped laminate is heated in an oven under a pressure to harden the resin. Thereafter the core metal is drawn from the laminate. Carbon fiber is used as the reinforcing fibers F11 to F19 of the fiber reinforced prepregs 11 through 19. Epoxy resin is used as the matrix resin.

The construction of the laminate of the fiber reinforced prepregs 11 through 19 is described below. Each of the prepregs 11 through 19 is wound at the number of plies (PLY) shown in FIG. 2.

In the fiber reinforced prepreg 11, the fibrous angle of the reinforcing fiber F11 with respect to the axis of the shaft 1 is 0° (straight layer). The tensile modulus of elasticity of the reinforcing fiber F11 and the tensile strength thereof are 294 GPa and 5490 MPa respectively. The length of the longer side of the fiber reinforced prepreg 11 and the shorter side thereof in the axial direction of the shaft 1 are set to 200 mm and 100 mm respectively. The thickness of the fiber reinforced prepreg 11 is set to 0.085 mm. The fiber reinforced prepreg 11 is disposed at the tip side as a tip-side reinforcing layer.

In the fiber reinforced prepregs 12 and 13, the fibrous angle of the reinforcing fiber F12 and that of the reinforcing fiber F13 with respect to the axis of the shaft 1 are −45° and +45° (angular layer) respectively. The tensile modulus of elasticity and tensile strength of each of the reinforcing fibers F12 and F13 are set to 382 GPa and 4900 MPa respectively. Each of the fiber reinforced prepregs 12 and 13 has a length of 1168 mm equal to the overall length of the shaft 1 and has a thickness of 0.057 mm.

In the fiber reinforced prepreg 14, the fibrous angle of the reinforcing fiber F14 with respect to the axis of the shaft 1 is 90° (hoop layer). The tensile modulus of elasticity of the reinforcing fiber F14 and the tensile strength thereof are 294 GPa and 5490 MPa respectively. The fiber reinforced prepreg 14 has a length of 1168 mm equal to the overall length of the shaft 1 and has a thickness of 0.050 mm.

In the fiber reinforced prepreg 15, the fibrous angle of the reinforcing fiber F15 with respect to the axis of the shaft 1 is 0° (straight layer). The reinforcing fiber F15 has a tensile modulus of elasticity of 320 GPa and a tensile strength of 5200 MPa. The length of the longer side of the fiber reinforced prepreg 15 and that of the shorter side thereof in the axial direction of the shaft 1 are set to 350 mm and 250 mm respectively. The thickness of the fiber reinforced prepreg 15 is set to 0.085 mm. The fiber reinforced prepreg 15 is disposed at the grip side as a grip-side reinforcing layer. That is, the high-elasticity and high-strength reinforcing fiber is used for the fiber reinforced prepreg 15.

In the fiber reinforced prepregs 16, 17, and 18, the fibrous angle of each of the reinforcing fibers F16, F17, and F18 with respect to the axis of the shaft 1 is set to 0°. The tensile modulus of elasticity and tensile strength of each of the reinforcing fibers F16, F17, and F18 are set to 320 GPa and 5200 MPa respectively. Each of the fiber reinforced prepregs 16, 17, and 18 has a length of 1168 mm equal to the overall length of the shaft 1 and has a thickness of 0.085 mm. That is, the high-elasticity and high-strength reinforcing fiber is used for the fiber reinforced prepregs 16, 17, and 18.

In the fiber reinforced prepreg 19, the fibrous angle of the reinforcing fiber F19 with respect to the axis of the shaft 1 is 0°. The tensile modulus of elasticity of the reinforcing fiber F19 and the tensile strength thereof are set to 294 GPa and 5490 MPa respectively. The length of the fiber reinforced prepreg 19 is set to 250 mm. The thickness of the fiber reinforced prepreg 19 is set to 0.105 mm. The fiber reinforced prepreg 11 is disposed at the tip side as a tip-side reinforcing layer.

The percentage of the weight of the high-elasticity and high-strength reinforcing fiber having a tensile modulus of elasticity not less than 300 GPa and a tensile strength not less than 5000 MPa to the weight of the entire reinforcing fiber of the straight layer including the reinforcing layers is set to 75%. A T-point flexure strength is 1890N in a test method carried out in accordance with a three-point flexure test of "Authorization standard of golf club shaft and standard confirmation method" (Admission 5 of the Ministry of International Trade and Industry, No.2087) provided by the Product Safety Association. The value of the grip-side flexure of the shaft is 127 mm. The value of the head-side flexure of the shaft is 118 mm.

As shown in FIG. 3, a thick part L is formed in the range from the tip 1*a* of the shaft 1 to a position spaced at an interval of 100 mm from the tip 1*a*. The maximum value of the thickness of the thick part L and the minimum value thereof are set to 2.2 mm and 1.8 mm respectively. The thickness change rate T1 of the thick part L is set to $4/1000$. A thickness transition part S having a length of 100 mm is formed adjacently to the butt of the thick part L. The thickness change rate T2 of the thickness transition part S is set to $10/1000$. That is, the thickness transition part S is spaced at an interval in the range of 100 mm to 200 mm from the tip 1*a*.

As described above, the reinforcing fibers F15 to F18 of the fiber reinforced prepregs 15 to 18 (straight layer) are high-elasticity and high-strength reinforcing fibers having a tensile modulus of elasticity not less than 300 GPa and a tensile strength not less than 5000 MPa. Therefore the present invention provides the shaft that is lightweight and balanced between its rigidity and strength. That is, the shaft has an appropriate degree of rigidity (flexure) and a high strength. The fiber reinforced prepregs 16 to 18 having the high-elasticity and high-strength reinforcing fiber are disposed over the whole length of the shaft. Further the fiber reinforced prepregs 11 and 19 (straight layer) having the reinforcing fiber whose tensile modulus of elasticity is lower than that of the high-elasticity and high-strength reinforcing fiber and whose tensile strength is higher than that of the high-elasticity and high-strength reinforcing fiber are disposed at the tip side as the reinforcing layer. Thus the shaft can be reinforced efficiently at it head side.

Examples and comparison examples of the shaft of the present invention will be described in detail below.

The length and weight of the shaft and the thick part thereof are set as shown in tables 1 and 2. The thickness change rate of the thickness transition part of each shaft is set to 0.010. Carbon fiber is used as the reinforcing fiber of the pretag of each shaft. Epoxy resin is used as the matrix resin. Table 3 shows the material for the prepreg of each shaft.

TABLE 1

| | Length L mm | Weight W g | W/L g/mm | Tip diameter of shaft ϕmm | Butt diameter of shaft ϕmm | Thick part at head-mounting side: Length mm | Thickness MAX mm | Thickness MIN mm | Thickness change rate | Ratio of weight of high-elasticity and high-strength reinforcing fiber to weight of entire reinforcing fibers of straight layer (%) |
|---|---|---|---|---|---|---|---|---|---|---|
| E1 | 1168 | 44 | 0.0377 | 9.0 | 15.6 | 100 | 2.2 | 1.8 | 0.004 | 75 |
| E2 | 1168 | 44 | 0.0377 | 9.0 | 15.6 | 100 | 2.2 | 1.8 | 0.004 | 46 |
| E3 | 1168 | 43 | 0.0368 | 9.0 | 15.6 | 100 | 1.8 | 1.3 | 0.005 | 75 |
| CE1 | 1168 | 44 | 0.0377 | 9.0 | 15.6 | 100 | 2.2 | 1.8 | 0.004 | 0 |
| CE2 | 1168 | 44 | 0.0377 | 9.0 | 15.6 | 100 | 2.2 | 1.8 | 0.004 | 0 |

TABLE 2

| | FLEX: Grip-side flexure mm | FLEX: Head-side flexure mm | Three-point flexure strength: T N | A N | B N | C N | Durability test |
|---|---|---|---|---|---|---|---|
| E1 | 127 | 118 | 1890 | 670 | 620 | 890 | ◎ |
| E2 | 132 | 120 | 1900 | 680 | 630 | 910 | ◎ |
| E3 | 127 | 120 | 1620 | 670 | 620 | 890 | ○ |
| CE1 | 141 | 130 | 1910 | 690 | 650 | 940 | ◎ |
| CE2 | 108 | 99 | 1460 | 480 | 440 | 640 | X |

where E denotes example and CE denotes comparison example.

TABLE 3

| Kind of fiber | Tensile modulus of elasticity Gpa | Tensile strength Mpa | Resin-containing amount % | Name of company |
|---|---|---|---|---|
| UM33 | 320 | 5200 | 25 | Toho Tenax Inc. |
| M30S | 294 | 5490 | 25 | Toray Industries Inc. |
| UM40 | 382 | 4900 | 25 | Toho Tenax Inc. |

EXAMPLE 1

The shaft of the example 1 had a laminated structure of prepregs similar to that of the first embodiment. The materials shown in table 3 was used. More specifically, UM33 (high-elasticity and high-strength) was used for the prepregs 15 through 18. M30S was used for the prepregs 11, 14, and 19. UM40 was used for the prepregs 12 and 13.

EXAMPLE 2

UM33 (high-elasticity and high-strength) was used for the prepregs 16 and 17. M30S was used for the prepregs 15 and 18. The other specifications of the shaft of the example 2 were similar to those of the shaft of the example 1. The percentage of the weight of the high-elasticity and high-strength reinforcing fiber to the weight of the entire reinforcing fiber of the straight layer was set to 46%.

EXAMPLE 3

The winding number of the prepreg 11 was three. The other specifications of the shaft of the example 3 were similar to those of the shaft of the example 1.

COMPARISON EXAMPLE 1

M30S was used for the prepregs 15 through 18. The other specifications of the shaft of the comparison example 1 were similar to those of the shaft of the example 1.

COMPARISON EXAMPLE 2

UM40 was used for the prepregs 15 through 18. The other specifications of the shaft of the comparison example 2 were similar to those of the shaft of the example 1.

The rigidity (flexure), the three-point flexure(bending) strength, and the durability of the shaft of each of the examples and the comparison examples were evaluated by a method that will be described later. Tables 1 and 2 show results of the evaluation.

Method of Measuring Flexure

Figure 4A:
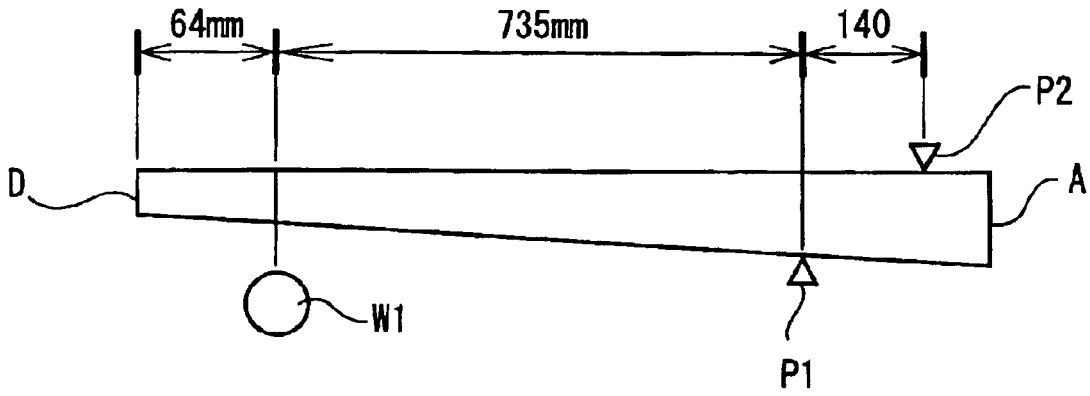
FIG. 4A shows a method of measuring a grip-side flexure.
Figure 4B:
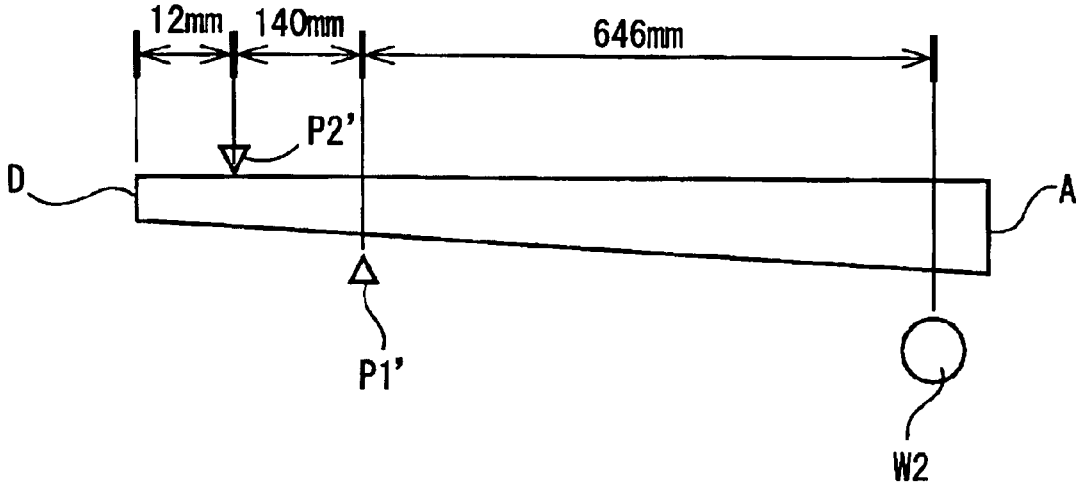
FIG. 4B shows a method of measuring a head-side flexure.

The grip-side flexure which is the index of the hardness of the shaft at its grip-mounting side was measured at a position of W45 inches. As shown in FIG. 4A, a position spaced at an interval of 799 mm from an end (tip) D of the shaft at which the head is mounted is denoted as a supporting point P1. A position spaced at an interval of 140 mm from the supporting point P1 toward a grip end A is denoted as a fixed point P2. A weight W1 of 2.7 kg was hung at a position spaced at an interval of 64 mm from the end D of the shaft to measure the flexure amount of the shaft at the end D. The head-side flexure is the index of the hardness of the shaft at its head-mounting side. As shown in FIG. 4B, a position spaced at an interval of 152 mm from the end D of the shaft is denoted as a supporting point P1'. A position spaced at an interval of 140 mm from the supporting point P1' toward the head-mounting side is denoted as a fixed point P2'. A weight W2 of 1.3 kg was hung at a position spaced at an interval of 798 mm from the end D of the shaft to measure the flexure amount of the grip end A of the shaft.

Three-Point Flexure(Bending) Strength Test

Figure 5:
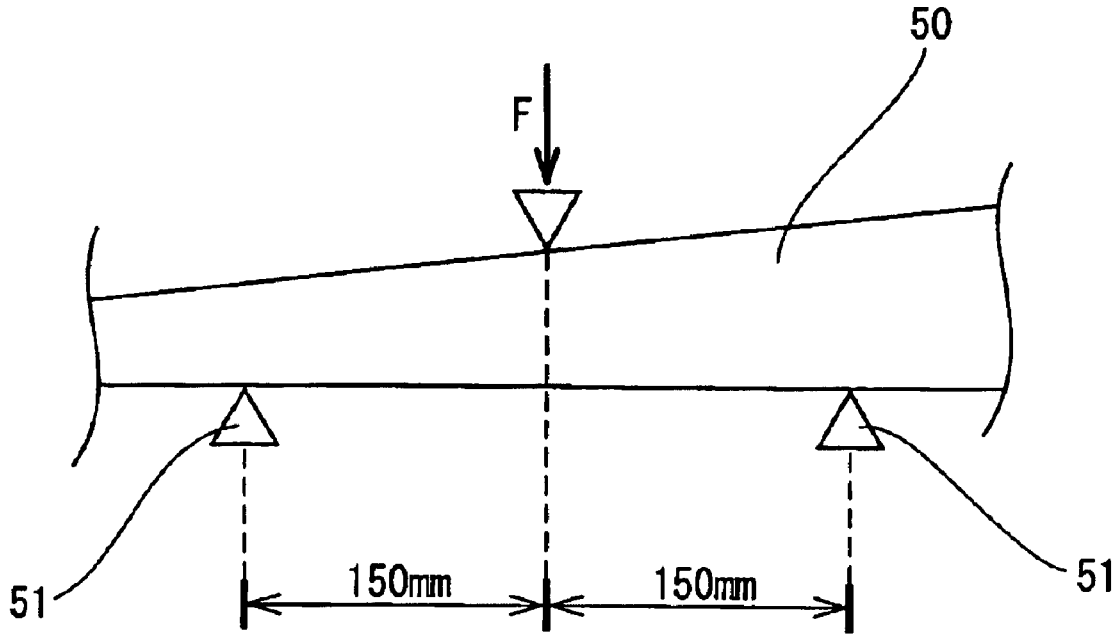
FIG. 5 shows a method of measuring a three-point flexure strength.

The three-point flexure strength means a breaking strength provided by the Product Safety Association. As shown in FIG. 5, a load F is applied from above to a shaft 50 supported at three points. The value (peak value) of the load when the shaft 50 was broken was measured. The flexure strength was measured at points spaced at intervals of 90 mm (point T), 175 mm (point A), and 525 mm (point B) from the tip of the shaft, respectively and a point C spaced at an interval of 175 mm from the butt of the shaft. The span between supporting points 51 was 150 mm only when the flexure strength was measured at the point T and 300 mm when the flexure strength was measured at the points A, B, and C.

Durability Test

A swing test was conducted to evaluate the durability of the shaft of each of the examples and the comparison examples. Using a swing robot (shot robot III) manufactured by Miyamae Co. Ltd., golf balls were hit at a head speed of 50 m/s with golf clubs each having the head-installed shaft of each of the examples and the comparison examples. The hitting point was spaced at an interval of 10 mm upward from a point spaced 30 mm from the club face center toward the heel. The shafts that were not broken when they hit golf balls at 3000 times were marked with ⊚. The shafts that were broken when they hit golf balls at 2000–3000 times were marked with ○. The shafts that were broken when they hit golf balls at 1000–2000 times were marked with Δ. The shafts that were broken when they hit golf balls at 1–1000 times were marked with X.

As shown in tables 1 and 2, the shaft of the examples 1 through 3 had prepregs each including the reinforcing fiber having a high tensile modulus of elasticity not less than 300 GPa and a high tensile strength not less than 5000 MPa as a part of the straight layer thereof. Therefore the value of each of the grip-side flexure and the head-side flexure was favorable, and the results of the three-point flexure strength and the durability test were also preferable. It was confirmed that the shaft was lightweight and had a proper degree of rigidity and a high strength.

The shaft of the example 2 had a lower rigidity (higher flexure) than that of the example 1. The shaft of the example 3 had a smaller number of turns of the prepregs 11. Thus the shaft of the example 3 had a little lower strength than the shaft of the example 1, but was more lightweight than the shaft of the example 1.

The shaft of the comparison example 1 was not provided with a sufficient rigidity (flexure). Thus when a golf ball is hit by the shaft of the comparison example 1, a player feels unreliable, has difficulty in taking an impact timing, and further the flight direction of the golf ball is unstable. The shaft of the comparison example 2 was provided with a sufficient rigidity (flexure), but had a low strength. Thus the shaft was broken.

As apparent from the foregoing description, according to the present invention, the shaft of the present invention has prepregs each including the reinforcing fiber having a high tensile modulus of elasticity not loess than 300 GPa and a high tensile strength not less than 5000 MPa as a part of the straight layer thereof which contributes most greatly to increase of the flexural strength of the shaft. Therefore it is possible to produce a high-performance shaft having a desired rigidity and a high strength very efficiently without increasing the weight thereof.

By layering the prepregs having the high-elasticity and high-strength reinforcing fiber, it is possible to improve the degree of freedom in designing a lightweight shaft. By combining these prepregs with prepregs having other performance, it is possible to obtain a lightweight shaft having desired performance.

What is claimed is:

1. A golf club shaft composed of a laminate of prepregs obtained by impregnating reinforcing fibers with a resin, wherein prepregs include a high-elasticity and high-strength reinforcing fiber having a high tensile modulus of elasticity not less than 300 GPa and a high tensile strength not less than 5000 MPa are disposed as a part of a straight layer in which said reinforcing fibers are parallel with an axial direction of said golf club shaft; and a weight (g) of said golf club shaft per unit length (mm) is less than 0.0385 g/mm.

2. The golf club shaft according to claim 1, wherein said high-elasticity and high-strength reinforcing fiber is a carbon fiber; and a ratio of a weight of said high-elasticity and high-strength reinforcing fiber to a weight of entire reinforcing fibers of all straight layers is not less than 50%.

3. The golf club shaft according to claim 1, wherein a T-point flexure strength is not less than 1600N in a test method to be carried out in accordance with a three-point flexure test of "Authorization standard of golf club shaft and standard confirmation method" (Admission 5 of the Ministry of International Trade and Industry, No.2087) provided by the Product Safety Association.

4. The golf club shaft according to claim 1, wherein a thick part is formed in a range from a tip of said golf club shaft to a position located in a range spaced at an interval of 70 mm to 150 mm from said tip; a thickness of said thick part is set to not less than 1.4 mm nor more than 2.8 mm; and a thickness change rate of said thick part is set to less than $^{5}/_{1000}$.

5. The golf club shaft according to claim 1, wherein at least one layer of a prepreg having said high-elasticity and high-strength reinforcing fiber is disposed over a whole length of said golf club shaft; and a prepreg of a straight layer having a reinforcing fiber whose tensile modulus of elasticity is lower than that of said high-elasticity and high-strength reinforcing fiber and whose tensile strength is higher than that of said high-elasticity and high-strength reinforcing fiber is disposed as a reinforcing layer at a tip side of said golf club shaft.

6. The golf club shaft according to claim 1, wherein at least one layer of a prepreg having said high-elasticity and high-strength reinforcing fiber is disposed over a whole length of said golf club shaft; and a prepreg of an angular layer having a reinforcing fiber whose tensile modulus of elasticity is higher than that of said high-elasticity and high-strength reinforcing fiber is disposed at an inner side of said prepreg having said high-elasticity and high-strength reinforcing fiber: and/or a prepreg of a hoop layer having a reinforcing fiber whose tensile strength is higher than that of said high-elasticity and high-strength reinforcing fiber is disposed at said inner side of said prepreg having said high-elasticity and high-strength reinforcing fiber.

* * * * *